US006039064A

United States Patent [19]

Hilton

[11] Patent Number: 6,039,064

[45] Date of Patent: Mar. 21, 2000

[54] IMPACT RESPONSIVE EXTENDIABLE ARM PICK-UP FOR WALKING CANE OR THE LIKE

[76] Inventor: William W. Hilton, 6717 NW. 58th Ct., Tamarac, Fla. 33323

[21] Appl. No.: 09/172,947

[22] Filed: Oct. 14, 1998

Related U.S. Application Data

[63] Continuation-in-part of application No. 08/824,499, Mar. 26, 1997, Pat. No. 5,826,605.

[51] Int. Cl.[7] ..... A45B 3/00

[52] U.S. Cl. ..... 135/66; 135/65; 135/74; 135/77; 135/911

[58] Field of Search ..... 135/65, 66, 74, 135/77, 911

[56] References Cited

U.S. PATENT DOCUMENTS 3,029,828 4/1962 Kravitt ..... 135/66
4,121,605 10/1978 Schmerl ..... 135/65
4,237,915 12/1980 Zabielski et al. ..... 135/74 X
5,176,160 1/1993 Osborn ..... 135/66
5,826,605 10/1998 Hilton ..... 135/66

*Primary Examiner*—Christopher T. Kent
*Attorney, Agent, or Firm*—Harold W. Hilton

[57] ABSTRACT

An arm extending assembly for attachment to a walking appliance such as a walking cane, to enable the appliance to be retrieved without requiring the user to bend over. The device extends an extendible arm upwardly in a direction normal to the surface upon which the walking appliance has fallen. The arm is extended responsive to impact of the assembly on the surface, such as the ground. The arm extending assembly includes a base member for attachment to a cane, an actuating mechanism including a spring biased rotatable arm for imparting rotation to the extendible arm, a spring biased locking mechanism for releasably locking the actuating mechanism to the housing and ground engaging means operatively connected to the spring biased locking mechanism for release of the locking mechanism to permit rotation of the rotatable arm of the actuating mechanism and, thus, rotation of the extendible arm responsive to impact of said ground engaging means with the ground or surface.

17 Claims, 18 Drawing Sheets

IMPACT RESPONSIVE EXTENDIABLE ARM PICK-UP FOR WALKING CANE OR THE LIKE

CROSS-REFERENCE TO RELATED APPLICATIONS

This is a continuation-in-part of U.S. Pat. No. 5,826,605, Ser. No. 08/824,499, entitled "Impact Responsive Extendible Arm Pick-Up For Walking Cane Or The Like" filed Mar. 26, 1997 by William W. Hilton.

FIELD OF THE INVENTION

The present invention relates to walking appliances and more particularly to an impact responsive arm extending assembly for a walking appliance which extends an arm from the appliance so as to permit the appliance to be picked up by a person unable to bend down.

BACKGROUND OF THE INVENTION

Many people suffer from chronic back, hip or other movement restricting conditions that are both painful and very limiting. Such people often find simple tasks such as bending over to pick up an object, such as a walking cane or crutch, which has inadvertently fallen to the floor or other surface, nearly impossible. People who have had hip replacement surgery, in particular, are restricted in this bending movement.

Some prior art patents such as U.S. Pat. Nos. 5,392,800, 5,392,801 and 4,947,882 address the problem of "bending over" to pick up a fallen cane. U.S. Pat. No. 5,392,800 is directed to a multi-purpose cane device and includes a rod positioned on the resilient foot portion or pad which covers the distal end of the cane. The rod remains in extended position while the cane is being used. The user must place his or her foot on the extending rod and apply a force by foot pressure which will cause the cane handle to swing upwardly. It should be obvious that if the cane should fall on the side from which the rod extends, the rod would be faced downwardly away from the user and thereby be inaccessible to contact by the user's foot. Additionally, the force required to rotate the cane upwardly by application of foot pressure on the extending rod would require that the hip joint of the user be placed under a great amount of stress causing pain and discomfort or even further injury to the already weakened hip joint.

U.S. Pat. No. 5,392,801 is directed to a self-righting walking cane having a weighted base provided with a center of gravity positioned below the center of rotation of the device. An unbalanced movement exists because of this relationship which causes the cane to roll on the surface to which it has fallen, and, right itself. A first problem that the user encounters in this device is the large mass which is positioned at the base of the cane and must be carried by the user. Additionally, such large mass would be continuously engaged by the foot of the user during the normal course of walking unless a special effort was made by the user to hold the cane further away from his or her body to provide a space between the large mass and the foot.

U.S. Pat. No. 4,947,882 is directed to crutches, walking sticks, and the like. U.S. Pat. No. 4,947,882 discloses a device which, like the device of U.S. Pat. No. 5,392,801, requires the user to apply a force to the base to raise the cane to its upright position.

The above mentioned difficulties are overcome by the actuator mechanism of the present invention which eliminates the need for any contact with the fallen walking appliance by the user in order to position the appliance in an upright position to enable the user to retrieve the appliance.

SUMMARY OF THE INVENTION

The arm extending assembly of the present invention is automatically operable responsive to impact of the assembly with the surface upon which the cane has fallen. Upon impact an arm is extended normal to the cane. The user merely grips the extended arm to retrieve the cane without bending over.

It is an object, therefore, of the present invention to provide mechanism for easily retrieving a fallen cane without the user having to bend over.

It is a further object of the present invention to provide an arm extending assembly for attachment to a cane which extends an arm in normal relation to the cane solely responsive to impact of the arm extending assembly with a surface such as a floor, walkway, street, etc.

These and other objects and advantages of the present invention will become more readily apparent from the following drawings and detailed description.

DESCRIPTION OF THE PREFERRED EMBODIMENTS

Figure 1:
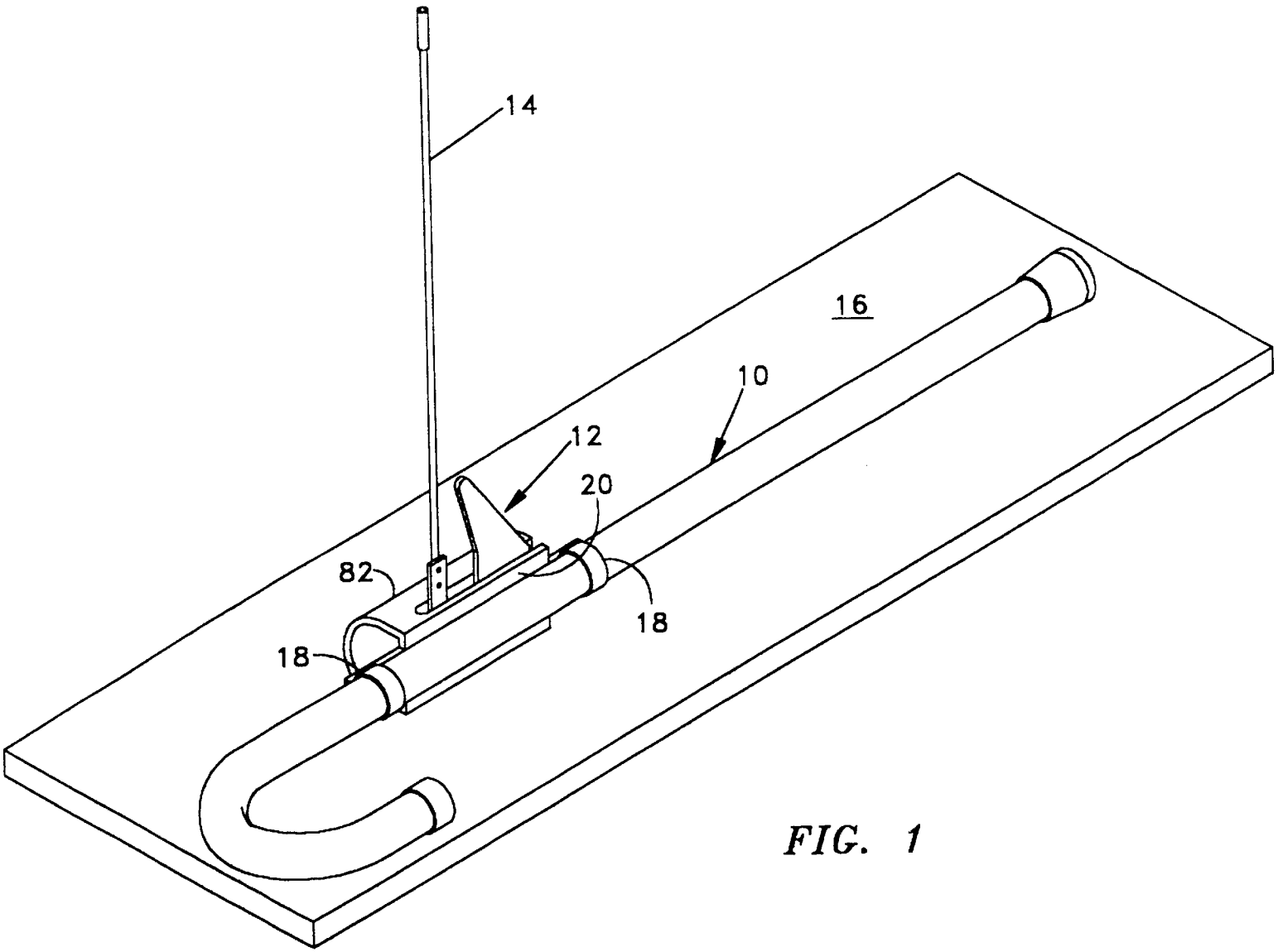
FIG. 1 is a pictorial view of a cane resting on a surface on which it has fallen. The cane is shown to have an extendible pick-up arm which provides a means for the cane user to pick up the cane without bending.

As seen in FIG. 1, a walking cane 10 is shown to be provided with an assembly including an actuator mechanism 12 for extending an arm 14 in substantially normal relation to the longitudinal axis of the cane responsive to impact of the actuator mechanism 12 with a surface 16 such as a floor, street, etc. onto which the cane has inadvertently fallen. The extending arm 14 permits the cane user to retrieve the fallen cane without bending over. Actuator mechanism 12 is shown to be secured to cane 10 by clamps 18.

Figure 2:
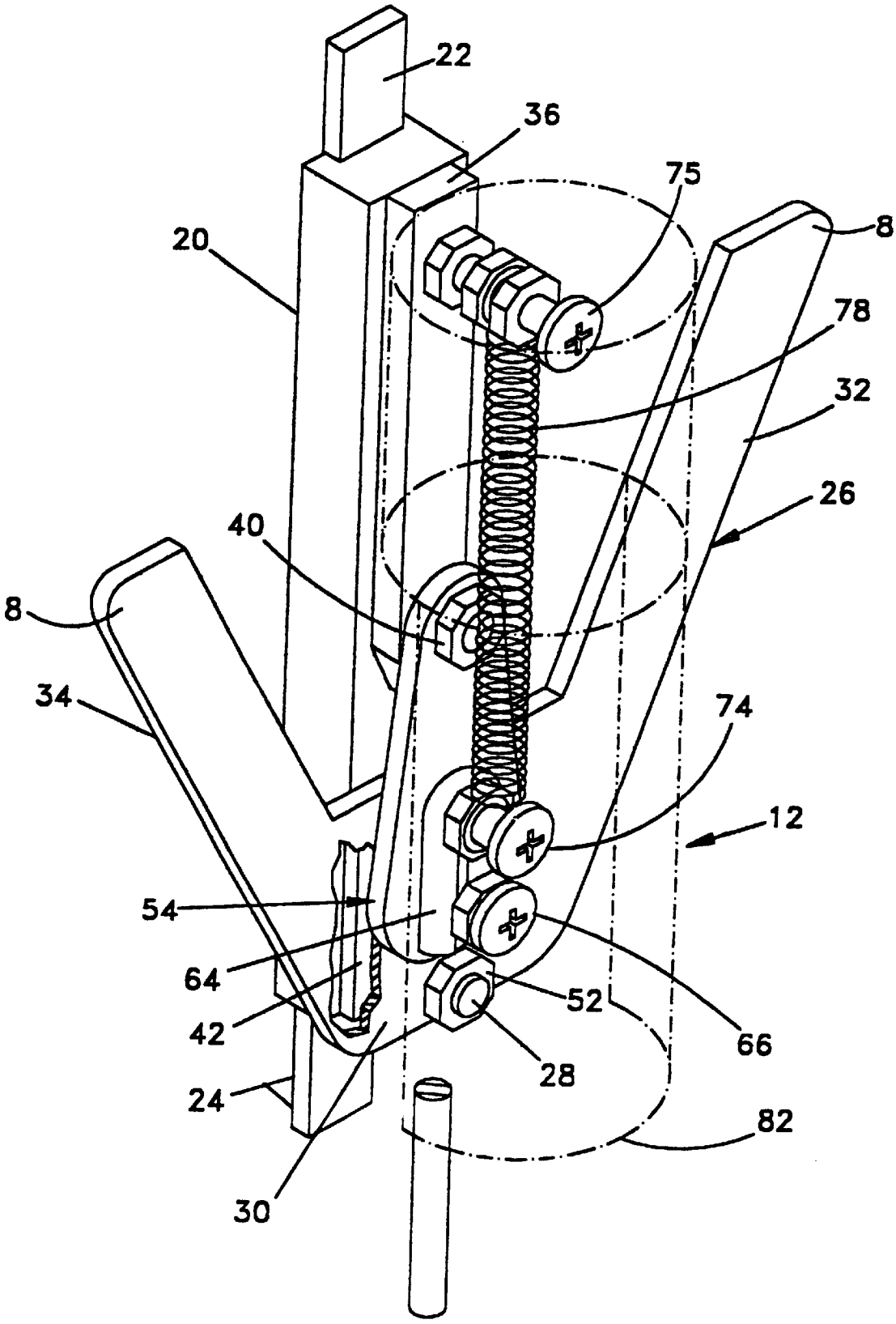
FIG. 2 is a perspective view of the actuator mechanism for the pick up arm of FIG. 1.

FIG. 2 is a perspective view of the actuator mechanism 12. As seen in FIG. 2, mechanism 12 includes a base member 20 having a pair of extending portions 22 and 24 at opposite ends thereof for secured relation to the cane by the clamp 18 (FIG. 1). A V-shaped element or member 26 is pivotally secured to base 20 by a screw 28 (FIGS. 2 and 3) and includes a forward apex area 30 from which a pair of fingers or arms 32 and 34 extend. Arms 32 and 34 extend rearwardly from apex area 30 and in angular relation therewith.

Figure 3:
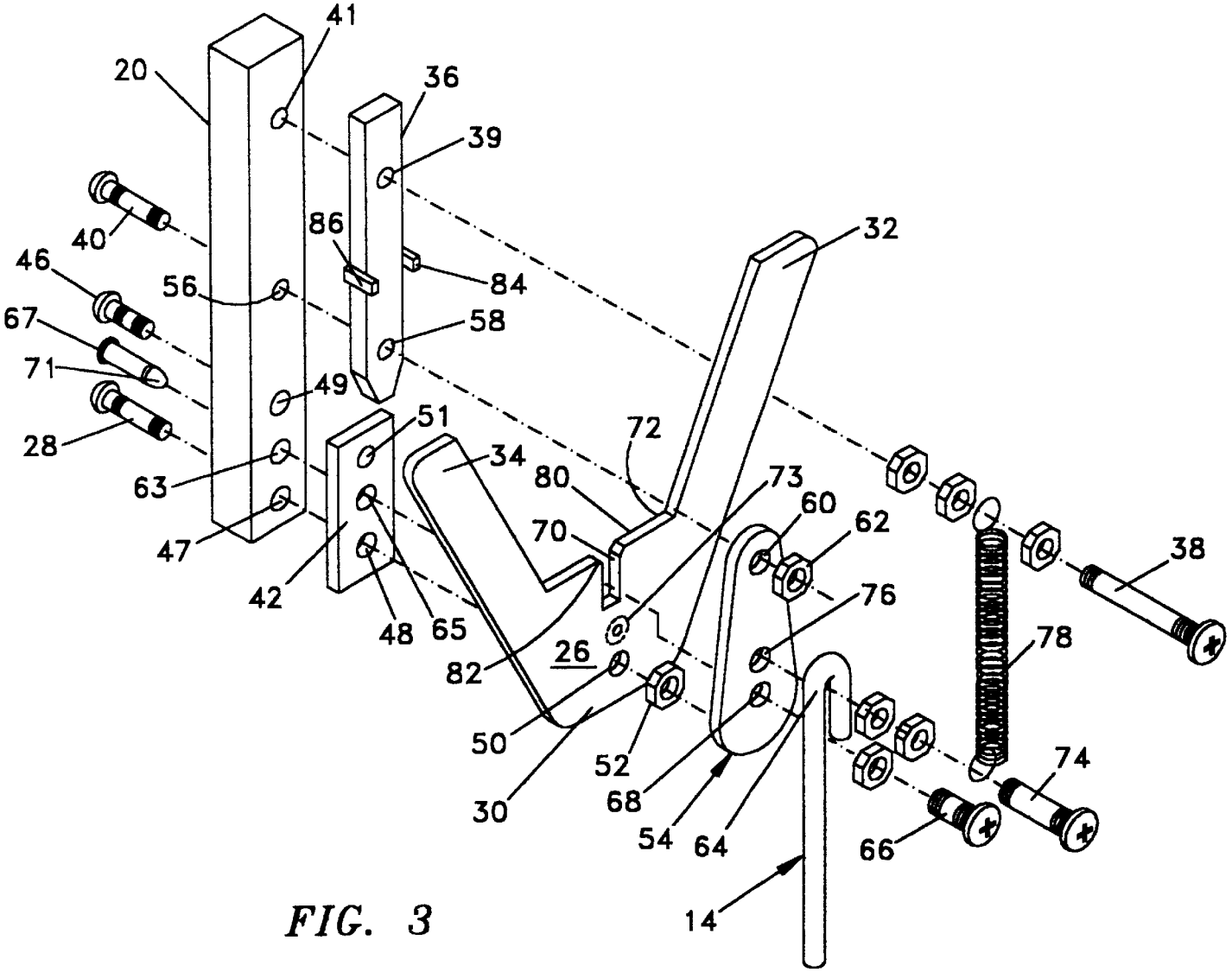
FIG. 3 is an exploded view of the actuator mechanism of FIG. 2.

As more clearly shown in FIGS. 2 and 3, base member 20 has a rear raised section 36 secured thereto by screws 38 and 40. Screw 38 extends through an opening 39 (FIG. 3) in raised section 36 and is secured in a threaded opening 41 of base member 20. As more clearly seen in FIG. 3, a forward raised section 42 is secured to base member 20 by screws 28 and 46. Screw 28 extends through openings 47, 48, and 50, respectively, of base member 20, forward raised section 42, and the forward apex area of V-shaped member or element 26. The arm member is rotatably secured to the forward raised section 42 by screw 28 and a nut 52. Screw 46 extends through an opening 49 of base member 20 and is secured in a threaded opening 51 of raised section 42.

To enable extendible arm 14 to be rotated from a non-extended position parallel to the axis of the cane to an extended position normal to the axis of the cane responsive to engagement of either wing 32 or wing 34 with surface 16, an extendible, spring biased rotatable arm support member 54 is provided. An arm support member 54 is rotatably mounted to rear raised section 36 by screw 40 which extends through openings 56, 58 and 60, respectively, of base member 20, raised section 36 and arm support member 54. Screw 40 is secured by a nut 62 adjacent the upper surface of arm support member 54. Extendible arm 14 has its end 64 secured to arm support member 54 by a screw 66 which extends respectively through arm 14, an opening 68 (FIG. 3) of support member 54 and protrudes into a slot 70 provided in the rear surface 72 of apex area 30 of V-shaped member 26 to retain support member 54 and arm 14 in non-rotated position. Screw 66 locks arm support member to V-shaped element or member 26 when the member 26 is in a non-rotated position. Pin 66 is released from the slot 70 upon rotation of wing 26 as described hereinbelow. A second screw 74 also secures arm 14 to arm support member 54. Screw 74 extends through end 64 of arm 14 and into a threaded opening 76 of arm support member 54.

Figure 4:
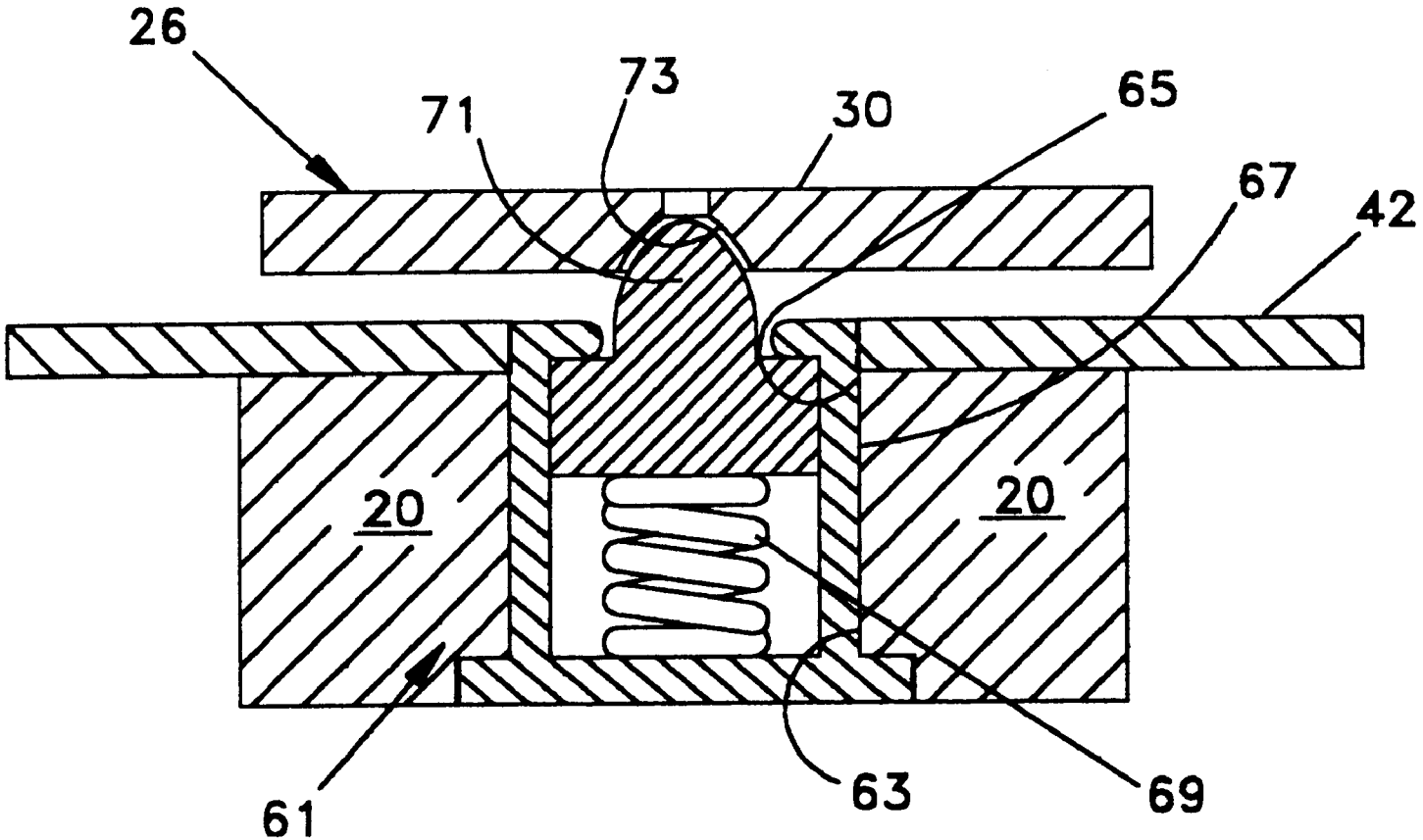
FIG. 4 is a sectional view of the locking device used to hold the wing in its normal unactuated position. The view illustrates the locking device in locked position with the wing member.

A "bullet catch" 61 (FIGS. 3 and 4) is mounted through opening 63 of base 20 and opening 65 of raised section 42. The "bullet catch" 61 is shown in FIG. 4 to include a housing 67 enclosing a spring 69 having a conically ended tip 71 secured thereto. One end of spring 69 is attached to the base of the housing and the second end of the spring is attached to tip 71. The housing 67 may be pressed into or threadably secured in openings 63 and 65. The under surface of the apex area 30 of V-shaped member 26 is shown in FIGS. 3 and 4 to be provided with a recessed or dimpled area 73 into which the tip 71 extends to lock the V-shaped member 26 in non-rotated position.

A spring 78 is secured between screw 38 and screw 74 to pivot arm support member 54 in an arcuate path about screw 40.

As seen in FIGS. 1 and 2 actuator mechanism 12 includes an arcuate housing member 82 which serves to cover and protect the components of mechanism 12 and also serves to roll the cane to either side to assure that one of the extending arms 32 and 34 will contact surface 16 responsive to the cane being inadvertently dropped thereon.

In operation, when the cane is inadvertently dropped by the user one of the extending arms 32 or 34 will engage or impact the surface 16 and will be rotationally displaced by the impact force to rotate V-shaped member 26 about its pivot 28. As the V-shaped member 26 is moved in its arcuate path about pivot 28 spring 69 of "bullet catch" 61 is compressed to allow tip 71 to move out of recess 73 and thus allow the V-shaped member 26 to freely rotate. As the V-shaped member rotates the arm support member 54 is urged off-center as a result of screw or pin 66 riding over either of the curved surfaces 80 or 82 adjacent slot 70. Once arm support member 54 has been urged to its off-center position, spring 78 continues to rotate the arm support member until it engages one of the stops 84 or 86 provided on section 36 of base member 20. Stops 84 and 86 are provided with means to retain the V-shaped member against the stops. FIG. 3 illustrates this retaining means as Velcro strips 85 positioned on the stops, and, strips 87 positioned on the inner edges 89 and 91, respectively, of 32 and 34. Other retaining mechanisms may be resorted to, if desired. For example, a resilient finger like member may extend from each stop member to frictionally engage a surface of arm 32 or 34 and retain the engaged arm 26 against the stop which it has engaged. Rotational movement of arm support member 54 moves extendible arm 14 to the position shown in FIG. 1, thereby enabling the user to retrieve the fallen cane without bending. Once the cane has been retrieved the user merely moves the arm back to its unextended position where it remains until the actuator mechanism is again actuated. Of course, with the arm in its unextended position the tip 71 of the "bullet catch" is engaged, spring biased relation in recessed area 73 of the assembly, and, pin or screw 66 is positioned into slot 70 of the V-shaped member.

Figure 5:
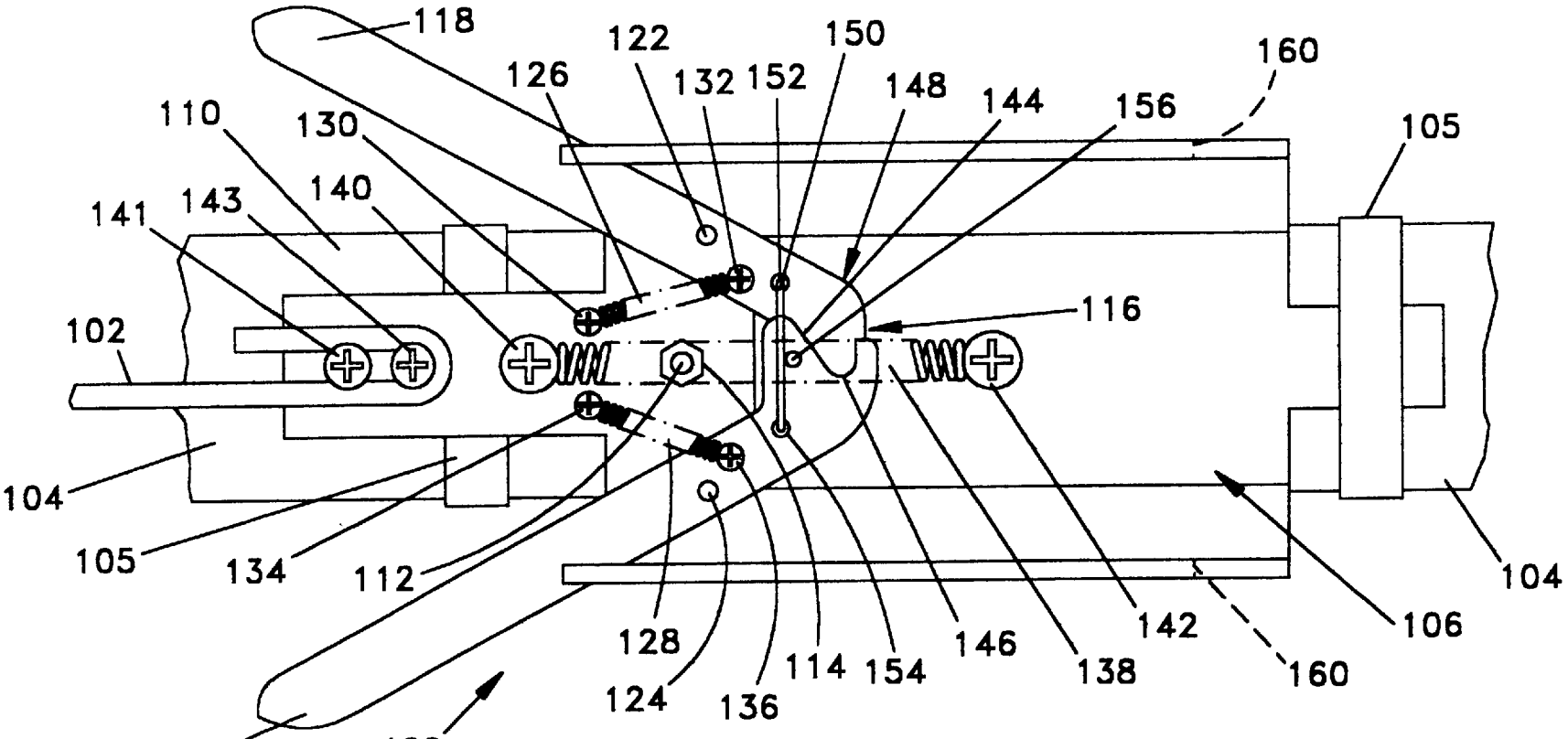
FIG. 5 is a plan view of another embodiment of an actuating mechanism for extending an arm from a cane as shown in FIG. 1.
Figure 6:
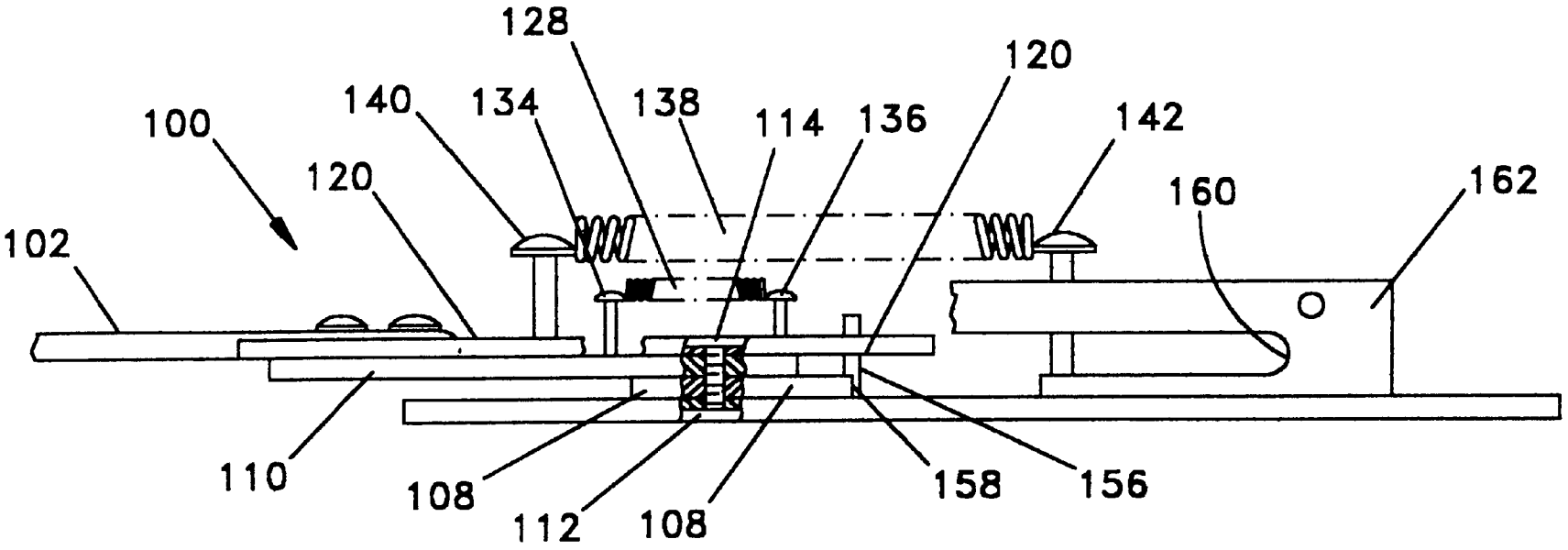
FIG. 6 is a top view of the actuating mechanism of FIG. 4.
Figure 7:
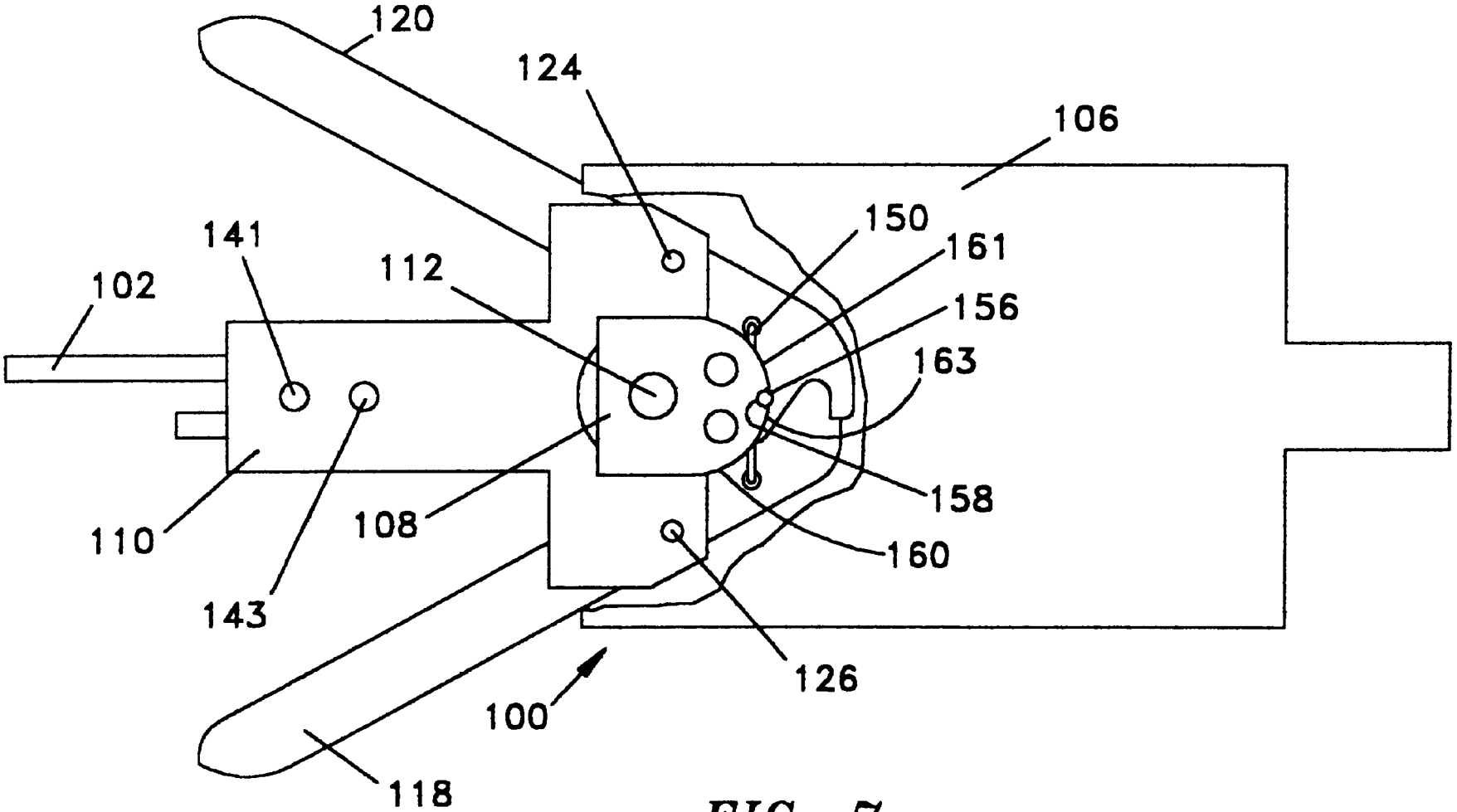
FIG. 7 is a bottom view of the actuating mechanism of FIG. 5. The base is partially broken away to show the cam mechanism of the device.

Another embodiment of the present invention is illustrated in FIGS. 5, 6 and 7. As seen in FIG. 5, 6 and 7 an actuator mechanism 100 is provided for extending an arm 102 to a position which is normal to the axis of a cane 104 to which it is attached by clamps 105. Actuator 100 is shown to include a base 106 having a cam 108 (FIG. 6) rigidly secured thereto. A rotatable extendible arm support member 110 is secured to cam 108. The rotatable arm support member 110 is mounted for rotational movement relative to cam 108, and, both cam 108 and arm support member 110 is secured to base 106 by a screw 112 and nut 114 (FIG. 6). A V-shaped assembly 116 is mounted to arm support member 110 to impart rotational movement thereto. V-shaped assembly 116 includes a pair of extending fingers or arms 118 and 120 which are respectively pivotally mounted to arm support member 110 by pins 122 and 124. Fingers 118 and 120 are also spring biased to arm support member 110 by springs 126 and 128. Spring 126 extends between a screw or pin 130 secured to arm support members 110 and a screw of pin 132 secured to finger 118. Spring 128 extends between a screw or pin 134 secured to arm support member 110 and a screw or pin 136 secured to finger 120. The arm support member is spring biased to base 106 by a spring 138. Spring 138 extends between a screw or pin 140 mounted on arm support member 110 and a screw or pin 142 mounted on base 106. An extendible arm 102 is secured to arm support member 110 by screws 141 and 143 as shown in FIGS. 5 and 6.

Fingers 118 and 120 are provided with complimentary curved mating surfaces 144 and 146 at the apex portion 148 of the V-shaped assembly. A clip member or spring 150 secures the fingers 118 and 120 together in relative movable relation. Member 150 is secured in holes 152 and 154 provided in fingers 118 and 120 respectively. A downwardly pin 156 (FIG. 6) extends from the bottom surface of finger 120 and protrudes into a groove 158 provided in a curved surface 160 of cam 108 (FIG. 7).

In operation, when the cane is inadvertently dropped by the user one of the extending fingers 118 or 120 will engage the surface on which the cane has fallen and will be displaced by the impact force to rotate V-shaped assembly 116 about pivot (screw) 112. In response to V-shaped assembly rotation the pin 156 is moved out of groove 158 of cam 108 and either spring 126 or 128 will further rotate the V-shaped assembly in the direction away from the impact point of the V-shaped assembly and the surface upon which the cane has fallen. As pin 156 is moved out of groove 158, mating surfaces 144 and 146 will slightly separate (approximately 1/16 of an inch) to permit pin 156 to ride over surfaces 161 and 163 adjacent the groove 158 (FIG. 7) and prevent binding of the pin in groove 158. Rotation of the V-shaped assembly causes arm support member 110 to rotate carrying extendible arm 102 with it until a finger of the V-shaped assembly engages a stop 160 provided on a housing 162 which encloses the actuating components. Housing 162 is shown broken away in FIG. 5; however, it is provided with an upper arcuate surface similar to the arcuate surface 82 of FIG. 1. The arcuate surface assures that the cane is rolled over to a position whereby the tip of a respective finger of the V-shaped wing assembly will engage the surface upon which the cane has fallen.

Figure 8:
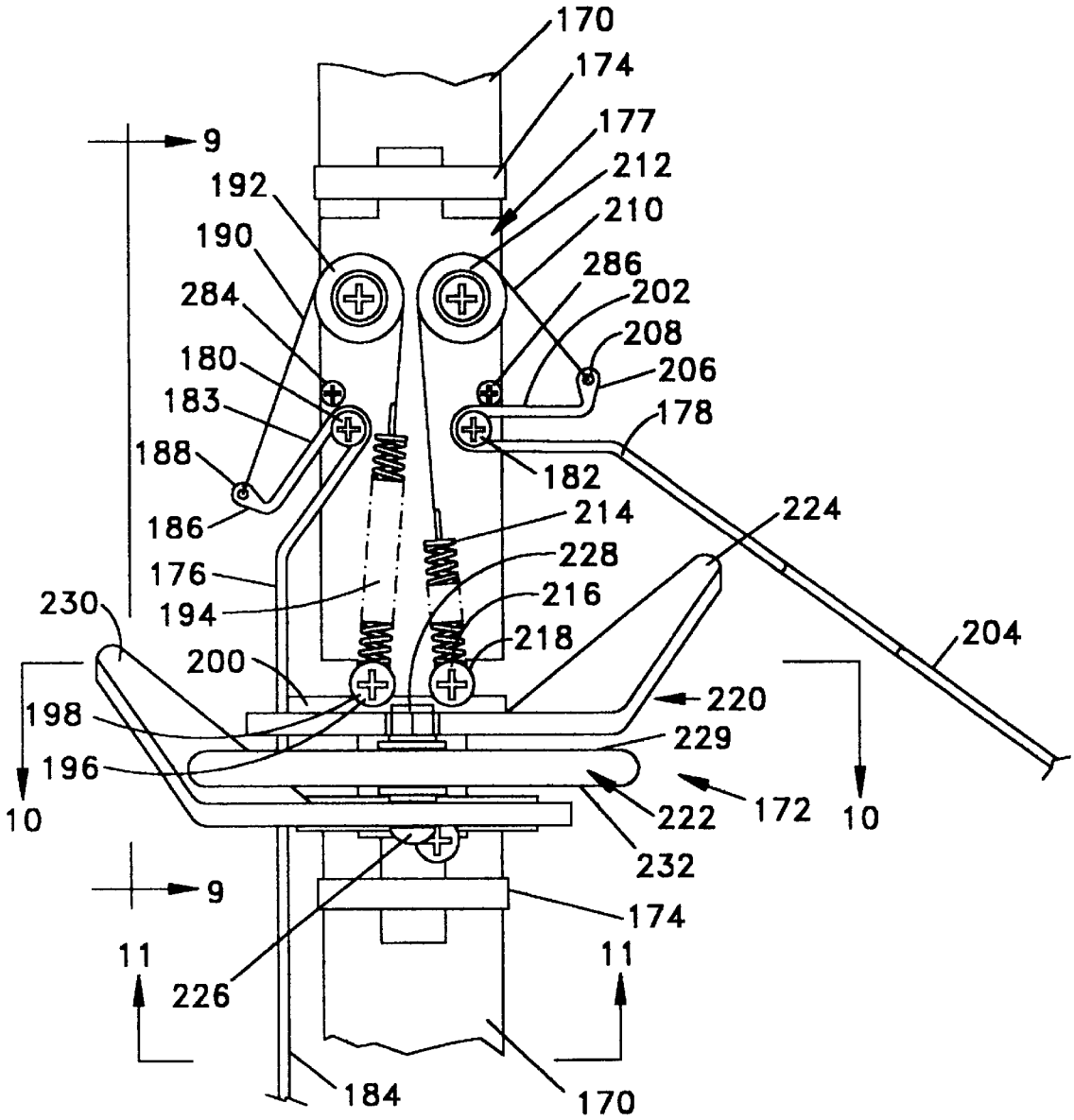
FIG. 8 is a plan view of another embodiment of the present invention which uses a pair of extendible arms.
Figure 9:
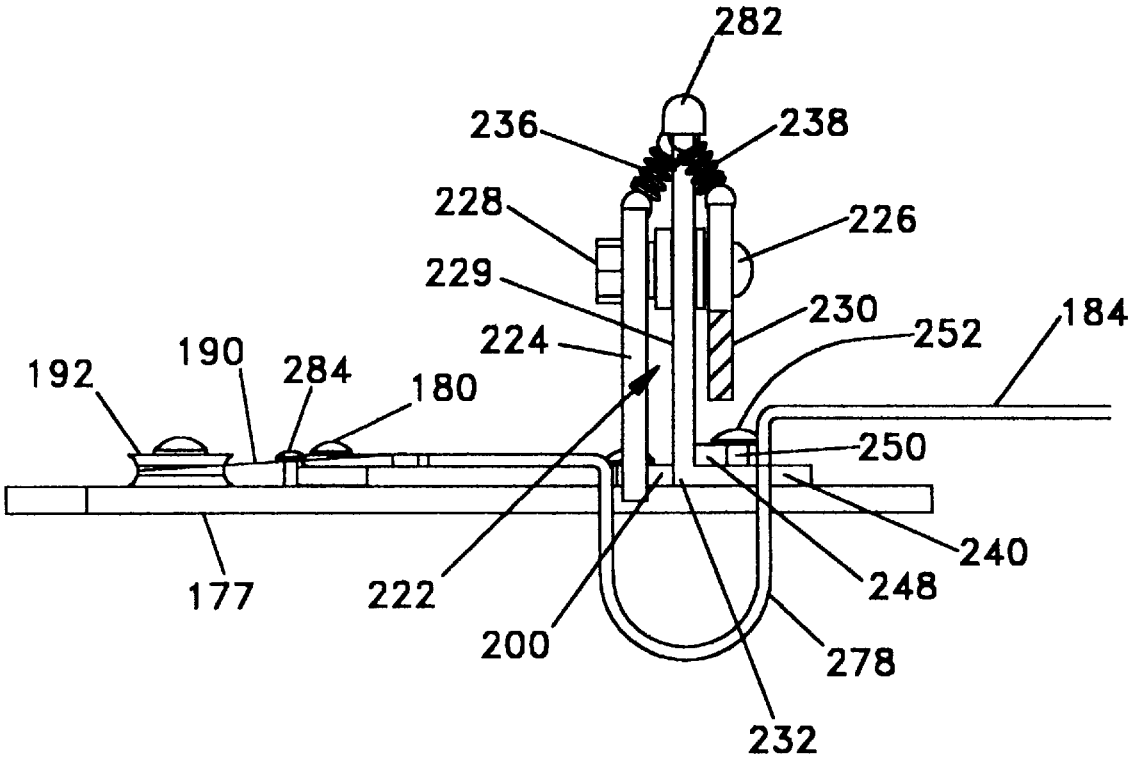
FIG. 9 is a view taken along line 8—8 of FIG. 7.

FIGS. 8–11 illustrate another embodiment of the invention wherein a pair of extendible arms are provided. As seen in FIG. 8, a cane 170 is shown to have an actuator mechanism 172 secured thereto by clamps 174. Actuator mechanism 172 is shown to be provided with a base plate 177 having a pair of extendible rotatable arms 176 and 178 pivotally secured thereto by pins or screws 180 and 182, respectively. Arm 178 is shown in FIG. 7 as being partially extended away from base plate 177. Arm 176 includes an upper curved portion having a downwardly extending short arm portion 183 and a downwardly extending elongated arm portion 184 which extends along the side of cane 170. Screw 180 extends through the U-shaped juncture of arm portions 182 and 184 for secured relation of arm 176 to base plate 177. Short arm portion 183 includes an extending distal end portion 186 having an opening 188 to which one end of a thin wire cable 190 is attached. Wire 190 extends over a pulley 192 which is rotatably secured to base plate 177 and attaches to a spring 194 which is secured to a pin or screw 196 secured to base plate 177 and having a substantially large diameter head 198 under which a spring biased slide B.A.R. 200 is retained.

In like manner, arm 178 includes an upper curved portion having a downwardly extending short arm portion 202 and a downwardly extending elongated arm portion 204. A screw 182 extends through the U-shaped juncture of arm portions 202 and 204 for secured relation of arm 178 to base plate 177. Short arm portion 202 includes a distal end portion 206 having an opening 208 to which one end of a thin wire cable 210 is attached. Wire 210 extends over a pulley 212 which is rotatably secured to base plate 177 and attaches to a spring 214 which is secured to a pin or screw 216 which is secured to base plate 177 and is provided with a substantially large diameter head 218 under which slide B.A.R. 200 is retained.

Figure 10:
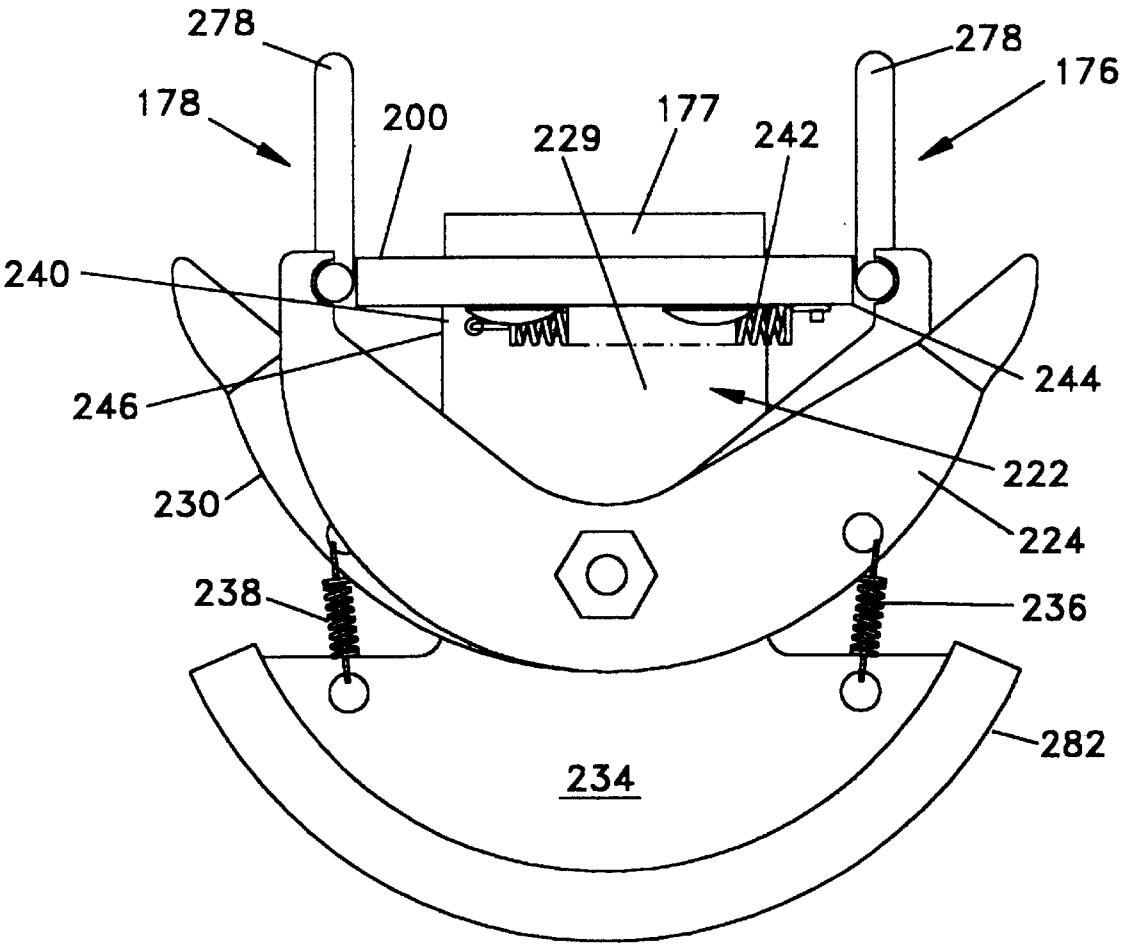
FIG. 10 is a view taken along line 9—9 of FIG. 7.
Figure 11:
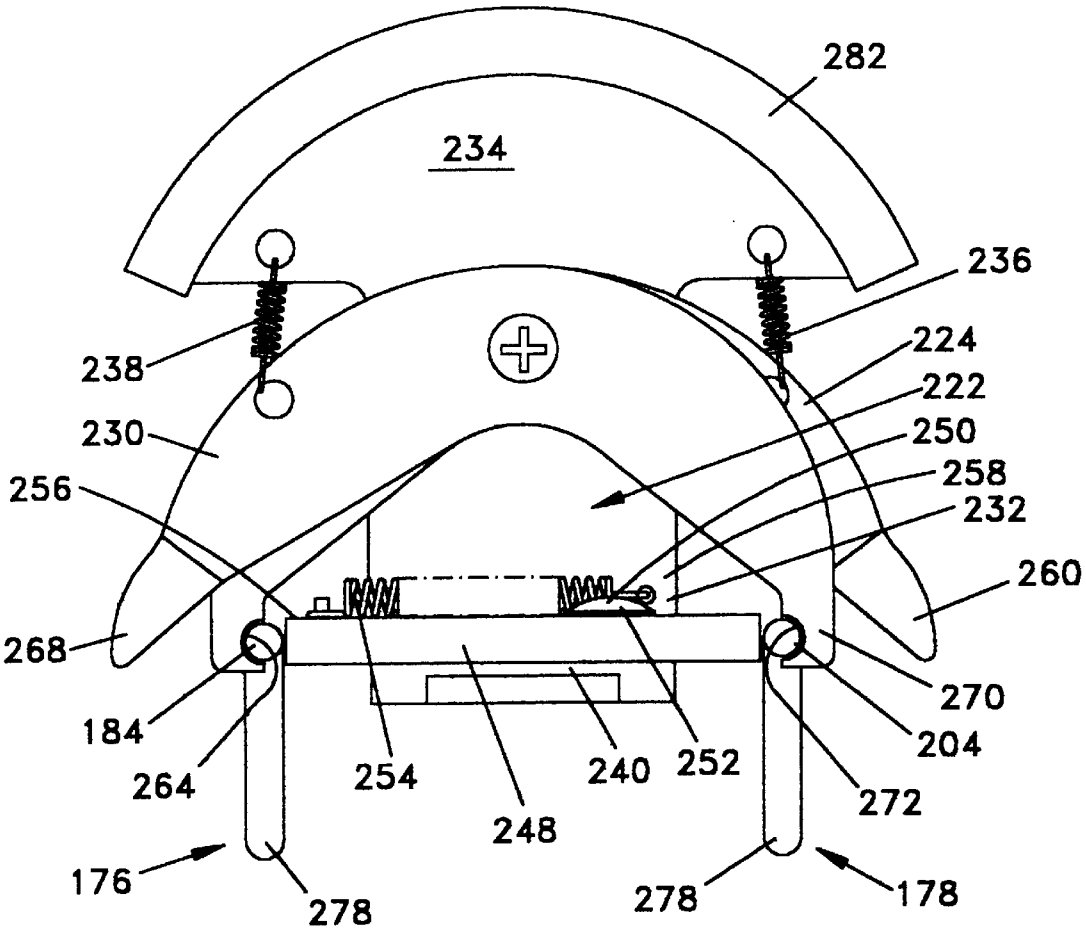
FIG. 11 is a view taken along line 10—10 of FIG. 7.

An assembly 220 is mounted to base plate 177 to retain the arms 176 and 178 in unextended position and to release arms 176 and 178 for extended relation normal to the axis of the cane. Assembly 220 includes an L-shaped support member 222 (FIG. 9) mounted to and extending normally from base plate 177. A first member 224 is rotatably attached by a screw 226 and nut 228 to the top surface 229 of support member 222. In like manner a second member 230 is rotatable secured by screw 226 and nut 228 to the bottom surface 232 of support member 222. As seen in FIG. 10, member 224 is spring biased to a forward portion 234 of support member 222 by a spring 236 and member 230 (FIG. 11) is spring biased to forward portion 234 of support member 222 by a spring 238.

Slide member 200 (FIGS. 9 and 10) is positioned on the base plate 177 against the base portion 240 (FIG. 9) of the upper surface 229 of support member 222. A spring 242 (FIG. 10) has one end secured adjacent one end 244 of slide member 200 and has its second end secured adjacent edge 246 of support member 222. A second slide member 248 (FIGS. 9 and 11) is positioned against the L-shaped base portion 240 of support member 222 which extends from the lower surface 232 of support member 222. A screw 250 secures slide member to base plate 177 and retains the slide member under a substantially large diameter head 252. A spring 254 is secured adjacent end 256 of slide member 248 and to an edge 258 of support member 222.

Member 224 includes an end or tip portion 260 (FIG. 11) extending beyond an edge of base plate 177. Tip 260 is disposed for engaging the surface to which the cane has fallen. The second end 262 of arcuate member 224 is provided with a notch 264 to receive elongated arm 184 therein. Elongated arm 184 is held in notch 264 by end 244 of slide member 200.

Member 230 includes an end or tip 268 (FIG. 11) extending beyond an edge of base plate 177. Tip 268 is disposed for engaging the surface to which the cane has fallen. The second end 270 of arcuate wing-like member 230 is provided with a notch 272 therein. Elongated arm 204 is held in notch 272 by an end 274 of slide member 248.

It should be noted that each of the arms 176 and 178 is provided with a downwardly curved area portion 278 to provide clearance for the tips 260 and 268 of the members 224 and 230 when they are rotationally displaced. It should also be noted that stops 284 and 286 are provided on the base plate to limit the rotational movement of arms 176 and 178.

A resilient member 282 is provided on the upper curved surface of support member 222 to protect the user from contacting the curved metal surface of member 222 and to provide a degree of resiliency to the surface contacting portion of the actuator.

In operation, if the cane is inadvertently dropped, one of the extending tips 260 or 268 (FIG. 11) will engage the surface upon which the cane has fallen and will respectively rotationally displace either member 224 or member 230. If member 224 is rotationally displaced, slide 200 is biased outwardly by spring 242 to urge arm 176 in an outward direction. After being initially urged outwardly by slide 200, spring 194 exerts a further rotational force on the end 188 of arm 176 to rotate arm 176 to the extended position.

In a similar manner, if member 230 is rotationally displaced, slide 248 is biased outwardly by spring 254 to urge arm 178 in an outward direction. After being initially urged outwardly by slide 248, spring 214 exerts a further rotational force on the end 206 of arm 178 to rotate arm 178 to the extended position.

Figure 12:
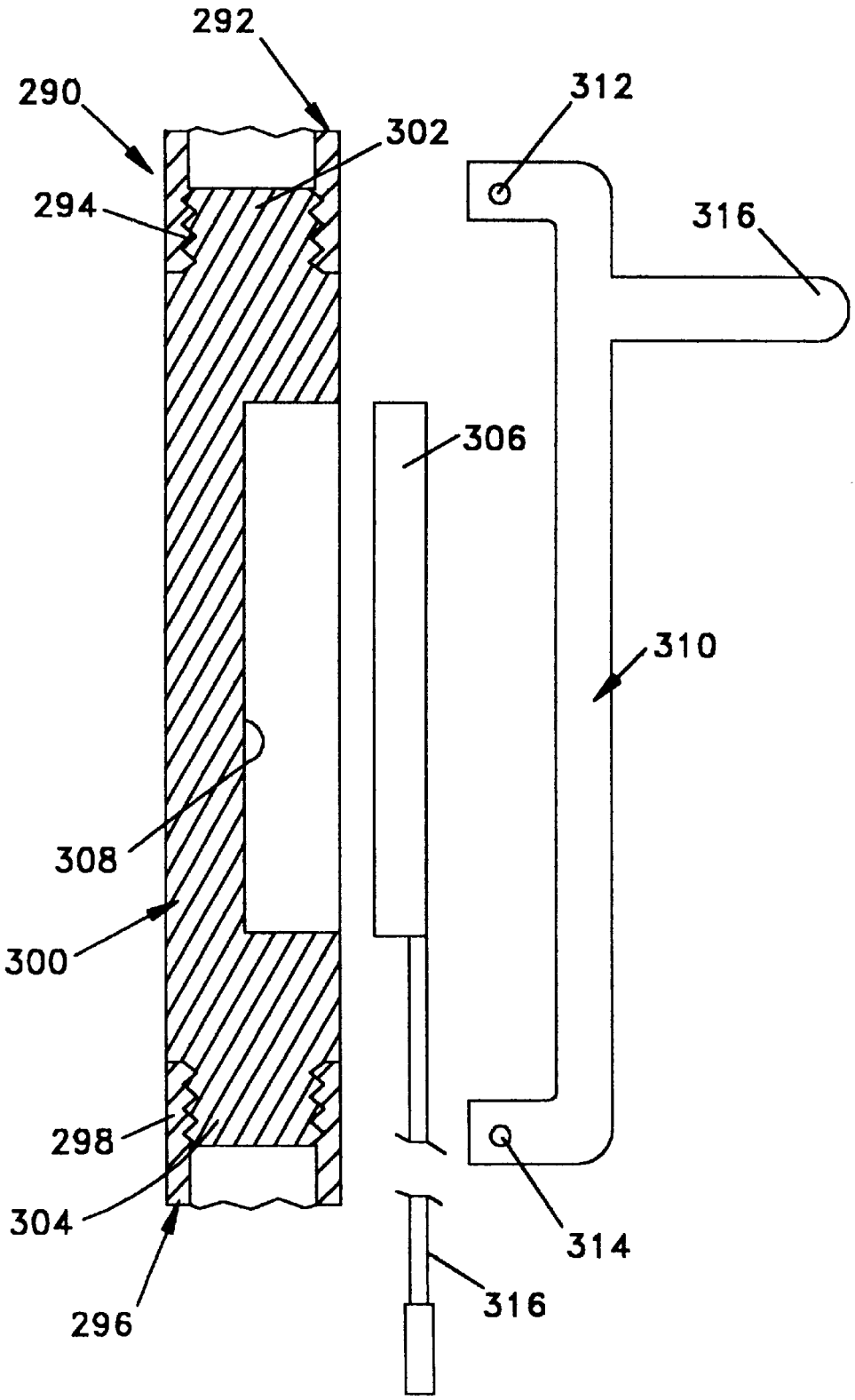
FIG. 12 is an exploded elevational view of another embodiment of the present invention.

An alternate embodiment of the present invention is illustrated in FIG. 12 which is an elevational sectional view diagrammatically illustrating the actuators of the present invention as being integral with a cane. It is understood that any of the previously discussed actuator mechanisms may be used in this embodiment. As seen in FIG. 12 a hollow cane 290 is shown to include an upper section 292 having a lower internally threaded portion 294 and a lower section 296 having an upper internally threaded portion 298. Sections 292 and 296 are joined together by a solid insert member 300. Member 300 includes an upper externally threaded portion 302 which is threadably secured to lower portion 294 of the cane. Insert member 300 further includes a lower externally threaded portion 304 which is threadably secured to the lower section 296 of the cane.

An actuator mechanism designated by the numeral 306 is shown for attachment to the inner surface 308 of section 300. The actuator, indicated by numeral 306, may be any of the aforementioned actuators 12, 100 and 172 of the invention. Surface 308 serves as the base to which the components of the actuators are mounted. A cover 310 is disposed for secured relation to the cane by screws or the like insertable into holes 312 and 314 of the cover and secured to sections 302 and 304, respectively of the solid cut-away member 300. A semi-circular member is secured to the cane to assure that the cane rolls over to a position which assures that the wings of the actuator engage the surface to which the cane has fallen as discussed, supra.

It is to be understood that while the arm extending assemblies of the present invention has been discussed in conjunction with walking canes this is not to be taken in a limiting sense since the actuator mechanisms may be also used in conjunction with crutches or a blind persons feeler "stick". However, when used with such a stick it may be desirable to provide a bend or knob at the distal end of the extendible arm to provide a larger area for the blind person to search for.

Figure 13:
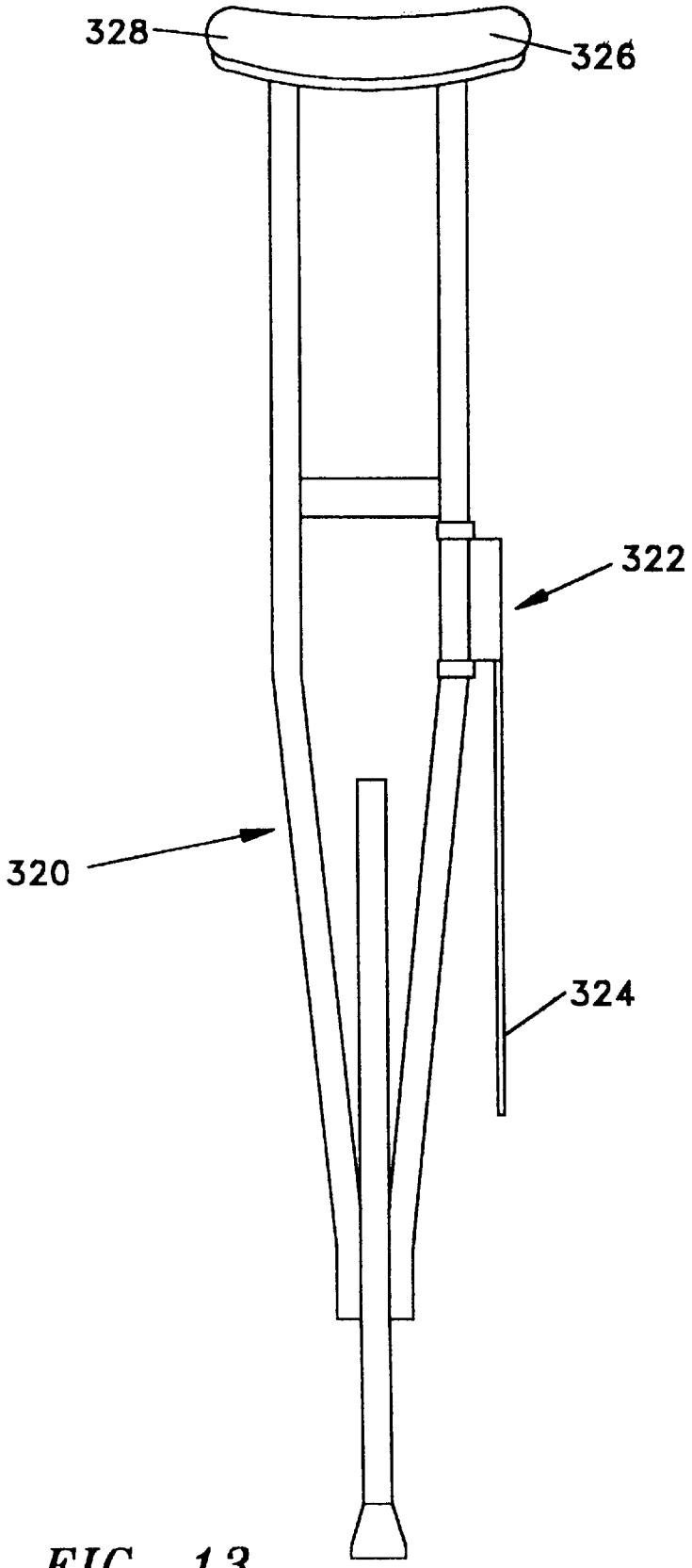
FIG. 13 is an elevational view of the actuator mechanism being used in conjunction with a crutch.

FIG. 13 illustrates the arm extending assemblies of the present invention as being used with a crutch. It is to be understood that any of the previously discussed arm extending assemblies may be used in this embodiment. As seen in FIG. 13 a crutch 320 is shown to be provided with an arm extending assembly denoted by the numeral 322 attached thereto. The assembly may be any of the above discussed arm extending assemblies. As seen in FIG. 13 an extendible arm 324 extends downwardly from the actuator mechanism 322 for extended relation from the crutch 320 upon impact with the actuator mechanism, as discussed supra. Should the crutch fall on either of the end surfaces 326 or 328 it will roll over to a position which will cause the actuating arms of any of the previously discussed arm extending assemblies to engage the surface and extend the arm 324.

In the embodiment of FIGS. 1–3, raised portions 36 and 42 are identified as being distinct members secured to the base, however, if desired, the base may be machined to have these raised sections integral therewith. If desired, raised section 42 may be completely omitted since it is only required that the plane in which arm support member 54 is located be above the plane in which the V-shaped member 26 is positioned. Also, in the embodiment of FIGS. 5–7 the cam member is shown to be secured to the base by a screw. However, if desired, the cam member may be formed directly on the base as an integral part thereof. Additionally, in the embodiment of FIGS. 8–11 the support member is shown and described as an L-shaped member which is secured to the base. However, if desired, the support member may be a straight upstanding member formed integral with the base. Accordingly, it is to be understood that all matters contained in the above description or shown in the accompanying drawing shall be interpreted as illustrative and not in limiting sense.

Figure 14:
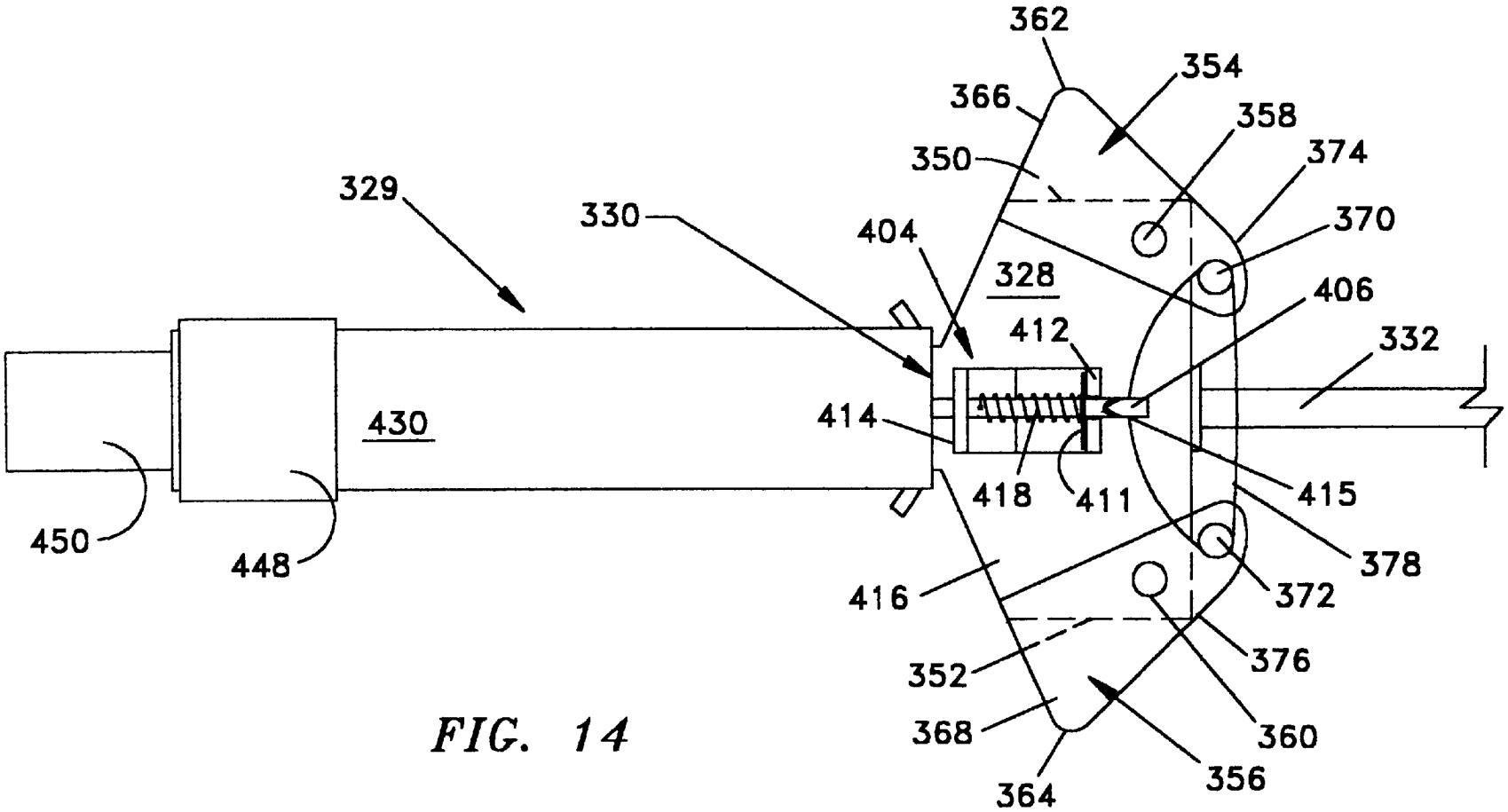
FIG. 14 is a plan view of another type of arm extending assembly for extending a pivotally mounted arm from a walking appliance, such as a cane, responsive to the appliance falling upon a surface such as the ground.

FIG. 14 is a plan view of another arrangement of an arm extending actuator mechanism 330 for extending an extendible arm 332 from a walking appliance such as cane 334 (FIG. 18) responsive to the cane 334 falling to, and an actuator mechanism 330 of the assembly engaging, a surface 338, such as the ground.

The arm extending assembly includes a base member for attachment to a cane, an actuating mechanism including a spring biased rotatable arm for imparting rotation to the extendible arm, a spring biased locking mechanism for releasably locking the actuating mechanism to the housing, and ground engaging actuating means operatively connected to the spring biased locking mechanism for release of the locking mechanism to permit rotation of the rotatable arm of the actuating mechanism and, thus, rotation of the extendible arm responsive to impact of said ground engaging means with the ground or surface.

Figure 15:
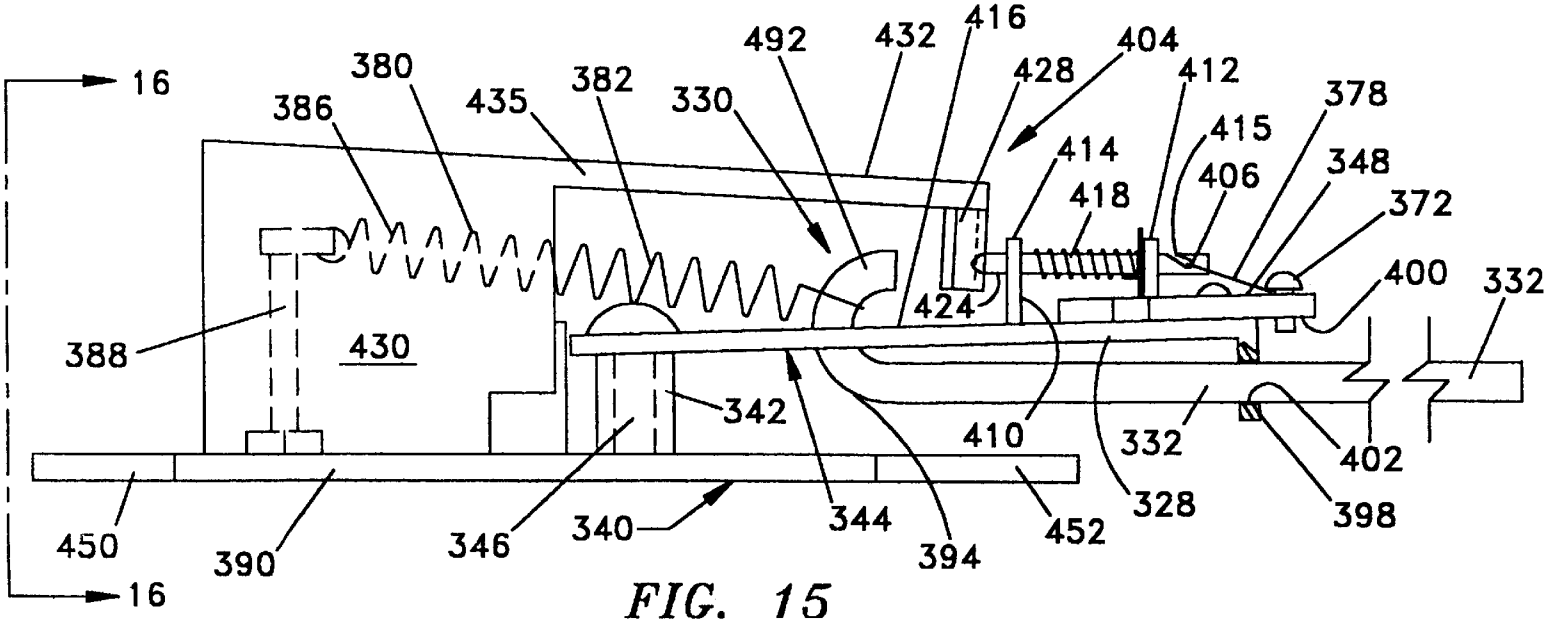
FIG. 15 is a side elevational view of the arm extending assembly of FIG. 14.
Figure 17:
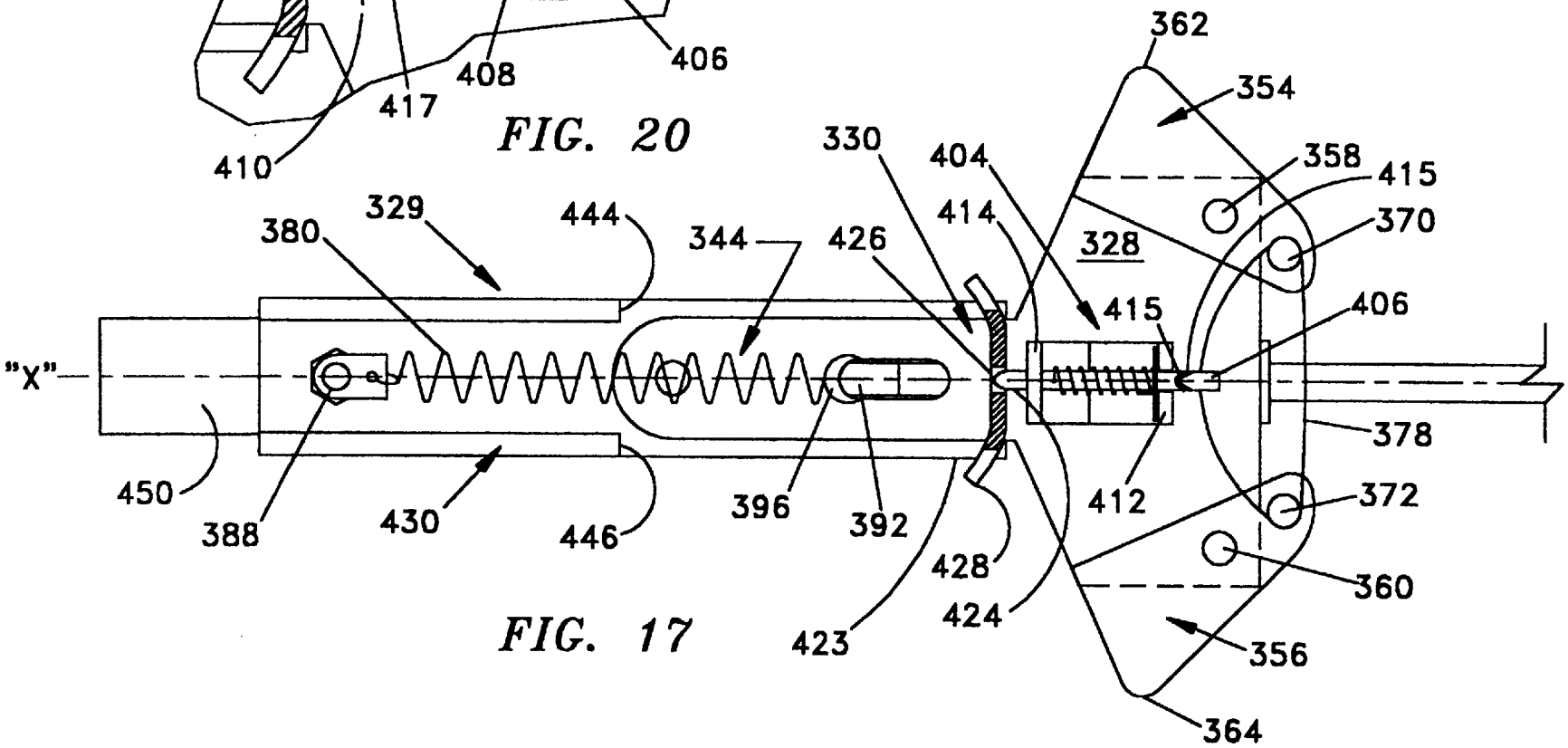
FIG. 17 is a plan view similar to FIG. 14 but has the top of the housing removed to illustrate the spring biased actuator arm of the arm extending assembly.

As more clearly seen in FIGS. 14, 15 and 17, assembly 329 includes a base member 340 having an upstanding support member 342 mounted thereto which rotatably supports a rotatable arm support member 344 of actuator mechanism 330. Arm member 344 is rotatably mounted to the base member 340 by a screw 346, or the like, which extends through support member 342 for secured relation with base member 340. Rotatable arm support member 344 extends away from the pivot point provided by screw 346 and includes an enlarged forward portion 328 which is provided with a pair of oppositely disposed rectangular end sections 350 and 352, each having a ground engaging member 354 and 356 pivotally mounted thereto by screws 358 and 360, respectively. Ground engaging members 354 and 356 are respectively formed with a surface engaging tip 362 and 364 at ends 366 and 368 thereof. A second pair of screws or pins 370 and 372 is provided on the second ends 374 and 376 of ground engaging members 354 and 356 to serve as a guide for a pliable member 378, such as nylon thread or piano wire which extends around pins 370 and 372 for reasons explained hereinbelow.

Rotatable arm member 344 is spring biased to base 340 by a spring 380 (FIGS. 15 and 17) which has one end 382 thereof attached to the rotatable arm member 344 and a second end 386 attached to a post 388 which is secured to and extends upwardly from a rear portion 390 of base member 340. Spring 380 is disposed in angular relation relative to base 340 and provides an upward pull on rotatable arm member 344. As shown in FIGS. 15 and 17, the lower end 382 of spring 380 is attached in a crook or bend 392 on the upper inner end 394 of extendible arm 332. Bend 392 extends upwardly through an opening 396 (FIG. 17) in member 344.

Rod or arm 332 extends forwardly from bend 392 and is attached to a tab 398 which depends from the under surface 400 of enlarged portion 348 of rotatable arm 344. This attachment is provided by extending rod 332 through an opening 402 of tab 398. The rod 332 is provided with an axis "X" (FIG. 17) which is normally disposed, in its non-extended position, parallel to the longitudinal axis of the cane to which it is attached.

To retain the rod in this non-extended position, a rod retention and releasing mechanism 404 is provided. This mechanism 404 is shown to include a slidably mounted, spring biased pin 406 which is mounted in a groove and an opening 408 and 410 (FIG. 18) of a pair of upstanding pin supports and guide members 412 and 414 (FIGS. 14, 15, 17, 18). Pin 406 is provided with a groove or opening 415 through which member 378 extends to form a loop around pins 370 and 372. Members 412 and 414 may be attached to or formed on the upper surface 416 of enlarged surface 328. A spring 418 encircles pin 406 and is mounted between guide members 412 and 414. One end of the spring abuts against member 411 and the second end of the spring is secured in an opening 417 of the pin. The spring is normally in an extended position but is compressed by displacement of the pin. The inner end 424 of pin 406 extends into an opening 426 (FIG. 17)of an arcuate end member 428 which is attached to and extends downwardly from an end 432 of housing 430.

Figure 20:
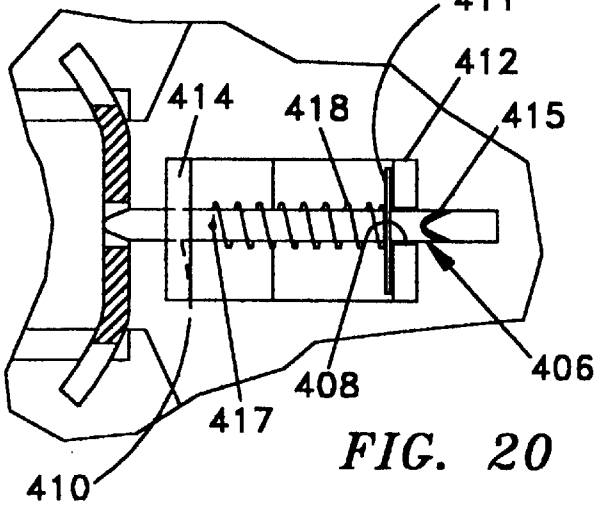
FIG. 20 is an enlarged view of a portion of the actuating mechanism showing the pin and spring assembly for releasably securing the base assembly and the extendible arm.

FIG. 20 is an enlarged plan view illustrating the pin and spring assembly of the actuating mechanism illustrated in FIGS. 14, 15 and 17.

Figure 16:
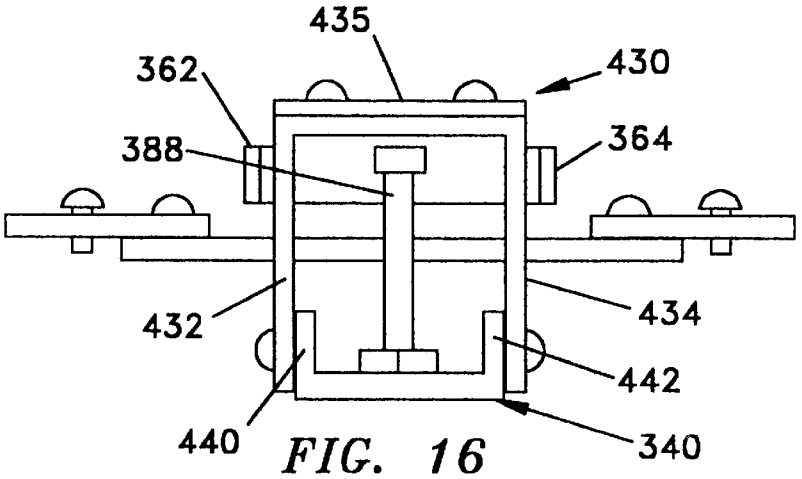
FIG. 16 is an elevational end view as seen along line 16—16 of FIG. 15.
Figure 18:
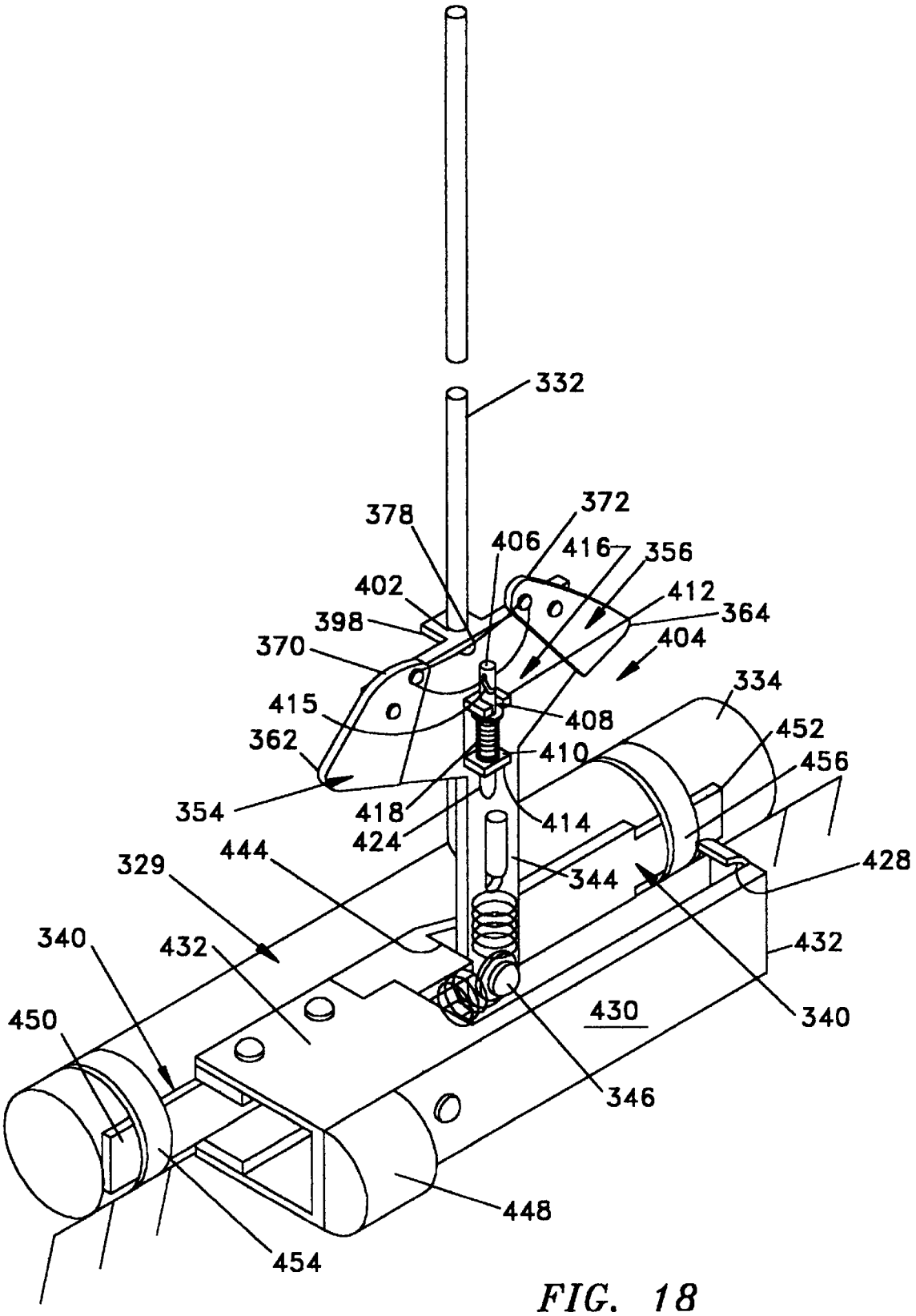
FIG. 18 is a pictorial view of a fallen cane with the arm extended by the arm extending assembly of the present invention.

Housing 430 is shown in FIGS. 15, 16 and 18 to include sides 432 and 434 and a top 435. Side 432 is shown attached to an upstanding side 440 of base 340 and side 434 is shown to be attached to an upstanding side 442 of base 340. The upstanding sides 440 and 442 of base 340 is provided with end surfaces 444 and 446 (FIGS. 17 and 18) against which the sides of arm member 344 abut when the arm is in extended position as shown in FIG. 18. A resilient member 448 is provided on the top of the housing to serve as a "bumper" for the mechanism.

In operation, when a cane user inadvertently drops the cane, the cane is forced to fall on a side due to the crook in the cane handle or due to the bumper effect of the bumper on the top of the upstanding housing thus forcing one of the surface engaging tips 362 and 364 to impact with the surface upon which the cane has fallen. This impact rotates the associated ground engaging member 354 or 356 inwardly which elongates the loop formed by member 378 as it extends through the opening 415 in pin 406 and around screws 370 and 372. This function of the loop being elongated causes a pulling effect of the loop on the pin which pulls pin 406 out of opening 426 of the downwardly depending arcuate housing member 428 so that the arm member 344 is no longer restrained from rotation. Also, the impact of one of the surface engaging tips with the surface imparts an initial rotational force to the member 344. Responsive to receiving the initial rotational force as a result of the impact and responsive to initial rotation of member 344, the spring 380 is forced "off-center" and exerts a sidewise pull on enlarged portion 348 of arm member 344. This action forces the movement of arm member 344 and rod 332 to the position shown in FIG. 18. Raised end portions 444 and 446 on base member 340 form stops which prevent excessive rotation of arm member 344. The sides of arm member 344 engages the stops when the arm 332 is extended as shown in FIG. 19.

Figure 19:
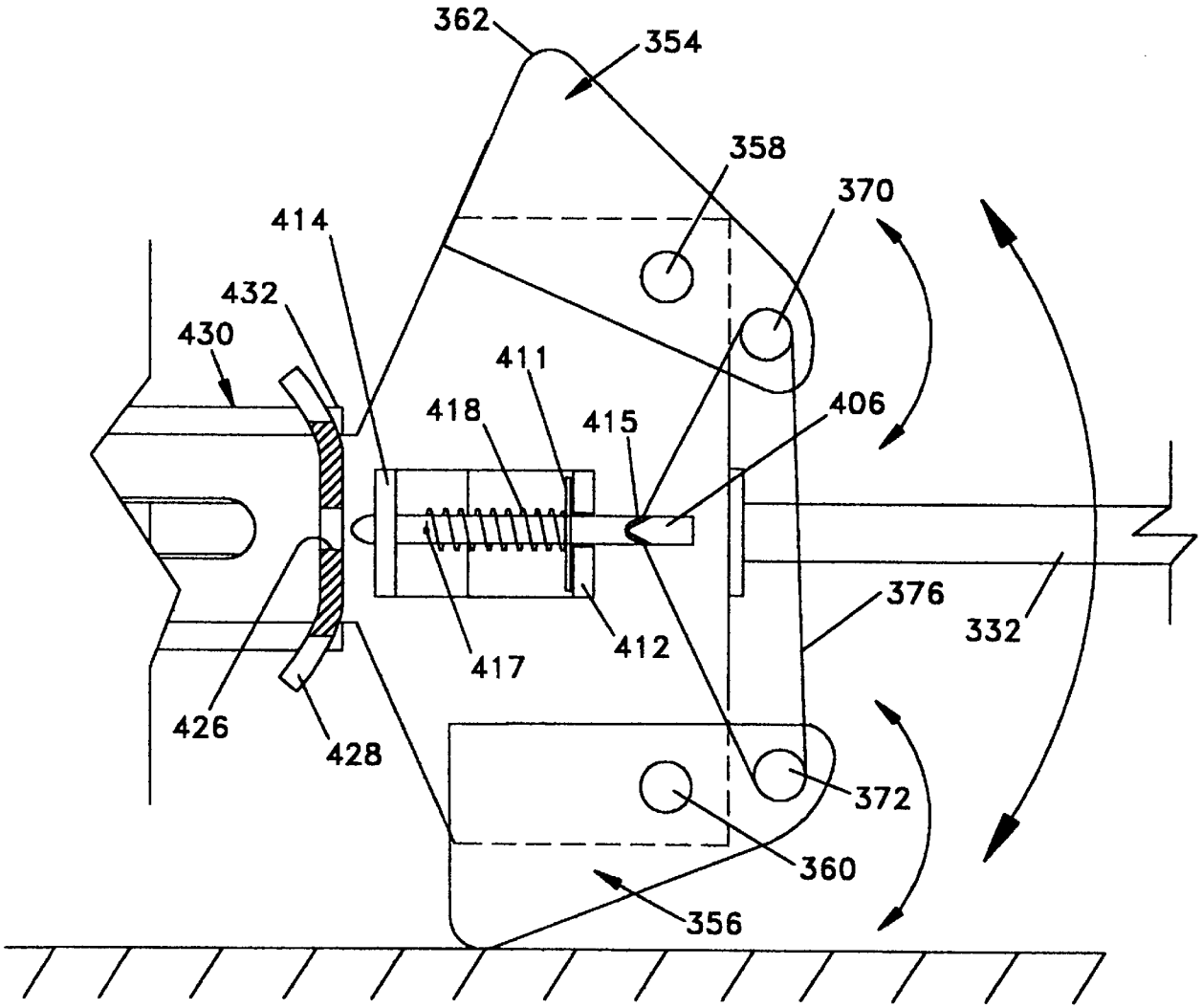
FIG. 19 is a top view of the impact responsive assembly (with the cane omitted for clarity) illustrating the position of the end ground engaging member just at the moment of impact with a surface. The retaining pin which secures the actuator arm of the assembly to the housing is illustrated as being displaced from locked engagement with the housing.

FIG. 19 illustrates the assembly at the movement which the tip 364 of ground engaging member 356 impacts with the ground. As seen in FIG. 19, the ground engaging member 356 is slightly rotated and the loop formed by member 376 is being drawn taught around screws 370 and 372 thereby pulling pin 406 out of opening 426 of member 428 against the bias of spring 418 thereby releasing arm member 344 to be rotated to displace rod 332 to the extended position shown in FIG. 18.

To provide for attachment of the assembly to a cane, the base member 340 includes a pair of oppositely extending end portions 450 and 452 which is secured to the cane by clamps 454 and 456 or the like.

It is to be understood that, if desired, the assembly 330 may be formed into and made integral with the walking cane in a manner similar to that shown in FIG. 12.

It is also again to be understood the arm extending assembly as described in FIGS. 14–19 may be utilized on a crutch as is illustrated in FIG. 13.

It is to be further understood that while the invention has been set forth herein with particularly, it will be apparent to those skilled in the art that various changes and modifications may be resorted to that is within the spirit and scope of the appended claims.

I claim:

1. An assembly for permitting the retrieval of a fallen walking appliance from a ground surface upon which it has fallen without requiring the user to substantially bend over, comprising:

a base member for attachment to said walking appliance;

an upstanding housing secured to said base member;

actuating means secured to said base member and including a spring biased rotatable arm secured thereto, said rotatable arm having outer edge surfaces, locking means including a spring biased locking means carried on said rotatable arm for releasable engagement with said housing, and, ground surface engaging means rotatably mounted adjacent said outer edge surfaces of said rotatable arm and operatively connected to said spring biased locking means for release thereof responsive to rotational movement of said ground surface engaging means which is in response to engagement of said ground surface engaging means with said ground surface; and an extendible arm secured to said rotatable arm for rotation therewith, said extendible arm disposed for displacement from a first non-extended position along the length of said walking appliance to an extended position substantially normal to the surface upon which said walking appliance has fallen, said displacement being responsive to impact of said ground engaging means.

2. An assembly as in claim 1 including support means for rotatably securing said rotatable arm to said base member.

3. An assembly as in claim 2 including a first spring secured between said rotatable arm and said base member, said spring longitudinally extending substantially parallel to the longitudinal axis of said walking appliance.

4. An assembly as in claim 3 wherein said spring includes first and second ends and said housing is provided with an upstanding post for attachment of said first end of said spring thereto.

5. An assembly as in claim 4 including means forwardly of said support means for securing said second end of said first spring to said rotatable arm.

6. An assembly as in claim 1 wherein said rotatable arm is provided with a forward upper surface having a pair of spaced, upstanding support members thereon for supporting a linearly moveable spring biased pin therebetween, said pin being operatively connected to said ground engaging means for actuation thereby.

7. An assembly as in claim 6 including means for operatively connecting said spring biased pin and said ground engaging members.

8. An assembly as in claim 7 wherein said housing includes a downwardly depending section having an opening therein.

9. An assembly as in claim 8 wherein said spring biased pin includes an end disposed for spring biased relation in said opening of said downwardly depending section of said housing for locked engagement of said rotatable arm with said housing.

10. An assembly as in claim 9 including means for pivotally mounting said ground surface engaging means to opposite side edges of said rotatable arms and a pair of upstanding guide members mounted on said ground surface engaging means.

11. An assembly as in claim 10 wherein said ground surface engaging means is defined by a pair of cam members, each cam member mounted on opposite sides of said rotatable arm, a continuous belt extending through said pin and around said guide members to exert a pulling force on said spring biased pin responsive to rotation of a said cam member in responsive to impact thereof with the ground surface.

12. An assembly as in claim 11 including stop means to limit the rotational movement of said rotatable arm.

13. A retrieval mechanism for retrieving a fallen elongated walking appliance without requiring the user to bend over comprising:

an elongated extendible arm member disposed for displacement from a non-extended position which is substantially parallel to said walking appliance to an extended position which is in a direction substantially perpendicular to the surface upon which the walking appliance has fallen;

a housing disposed for secured relation with said walking appliance;

means for securing said retrieval mechanism to said walking appliance, actuating means including a spring biased rotatably mounted actuating arm member mounted to said walking appliance, said extendible arm mem member being secured to and extending from said actuating arm member for rotation therewith;

releasable retaining means for locked engagement of said actuating means relative to said walking appliance to prevent relative rotation therebetween and for release of said locked engagement to permit rotation of said actuating means to extend said elongated extendible arm to said extended position; and surface engaging means rotatably carried by said actuating arm member to effect the release of said locked engagement of said actuating means and said housing to permit rotational displacement of said actuating arm member and said elongated extendible arm member responsive to impact of said surface engaging means with a surface.

14. A retrieval mechanism as in claim 13 wherein said actuating arm member includes an enlarged portion having first and second opposite sides, and said surface engaging means includes a rotatably mounted surface engaging member disposed at each said opposite side.

15. A retrieval mechanism as in claim 14 wherein said housing includes a downwardly depending member and wherein said releasable retaining means include a spring biased pin carried by said actuating arm member for locked engagement with said downwardly depending member of said housing, said surface engaging means being operatively connected to said pin to release said pin from the locked engagement with said housing.

16. A retrieval mechanism as in claim 15 including pair of guide members each being mounted adjacent a said side of said enlarged portion of said actuating arm member, and, a pliable member extending through said pin and around said guide members, said pliable member disposed for displacement of said pin from said locked relation responsive to rotation of either of said ground engaging members.

17. A retrieval mechanism as in claim 13 including stop means mounted on said housing to limit the rotational movement of said actuating arm member.

* * * * *